US011774210B1

(12) United States Patent
Chang

(10) Patent No.: US 11,774,210 B1
(45) Date of Patent: Oct. 3, 2023

(54) SILENT COCKING DEVICE FOR A CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/867,839

(22) Filed: Jul. 19, 2022

(51) Int. Cl.
*F41B 5/18* (2006.01)
*F41B 5/14* (2006.01)
*F41B 5/12* (2006.01)

(52) U.S. Cl.
CPC ..... *F41B 5/1469* (2013.01); *F41B 5/123* (2013.01)

(58) Field of Classification Search
CPC ..... F41B 5/1469; F41B 5/12; F41B 5/123
USPC ..... 124/25, 90
See application file for complete search history.

(56) References Cited

U.S. PATENT DOCUMENTS 6,286,496 B1 * 9/2001 Bednar ..... F41B 5/123 124/25
6,874,491 B2 * 4/2005 Bednar ..... F41B 5/1469 124/25
7,100,590 B2 * 9/2006 Chang ..... F41B 5/123 124/25
7,784,453 B1 * 8/2010 Yehle ..... F41B 5/1469 124/25
8,240,299 B2 * 8/2012 Kronengold ..... F41B 5/123 124/90
8,375,928 B1 * 2/2013 Bednar ..... F41B 5/1469 124/25
8,443,790 B2 * 5/2013 Pestrue ..... F41B 5/12 124/25
8,689,774 B1 * 4/2014 Ritz ..... F41B 5/1469 124/25
8,950,385 B1 * 2/2015 Khoshnood ..... F41B 5/1469 124/90
9,341,434 B2 * 5/2016 McPherson ..... F41B 5/123
9,752,844 B1 * 9/2017 Huang ..... F41B 5/12
10,295,295 B2 * 5/2019 Shaffer ..... F41B 5/12
10,295,299 B2 * 5/2019 Vergara ..... F41B 5/1469
10,421,637 B1 * 9/2019 Huang ..... F41B 5/123
10,612,884 B2 * 4/2020 Walthert ..... F41B 5/1411
10,900,738 B1 * 1/2021 Hensel ..... F41B 5/123
10,948,257 B1 * 3/2021 Huang ..... F41B 5/1449
11,067,357 B1 * 7/2021 Chu ..... F41B 5/1449
11,346,632 B1 * 5/2022 Kempf ..... F41B 5/1449
11,448,478 B2 * 9/2022 Wei ..... F41B 5/1469
11,466,957 B1 * 10/2022 Liu ..... F41B 5/12
2018/0321011 A1 * 11/2018 Yehle ..... F41B 5/1469

* cited by examiner

*Primary Examiner* — Alexander R Niconovich

(57) ABSTRACT

A crossbow is provided with a silent crank-cocking device including a shaft extending through a positioning sleeve, reels, a housing, a bushing, covers, a shaft sleeve, limiting pieces and a clutch wrench. A crank is connected to an end of the shaft. The reels are connected to two ends of the shaft. The housing receives the bushing, which includes a hole and clutch slots. The covers are connected to both ends of the housing. Rollers are located in the clutch slots. The limiting pieces are arranged on two ends of the shaft sleeve. The clutch wrench includes a portion connected to the rollers in the housing and another portion extending from the housing.

10 Claims, 10 Drawing Sheets

SILENT COCKING DEVICE FOR A CROSSBOW

FIELD OF THE INVENTION

The present invention is related to crossbows and, more particularly, to a silent cocking device for a crossbow.

BACKGROUND OF THE INVENTION

A conventional-crossbow includes a bow body, a limb at one end of the bow body, and a bowstring connected to the limb.

When operating the crossbow, the user draws the bowstring back to the triggering position with force and completes the archery operation of the crossbow with the action of loading the arrow and firing. However, the way of relying on the user's arm force to draw the bowstring alone is very taxing on the user's strength.

In order to overcome this drawback, there have been proposed string cocking mechanisms to solve this shortcoming, such as U.S. Pat. Nos. 6,874,491, 7,100,590, 8,375,928, 8,443,790, 8,689,774, 6,286,496, and other previous cases, whose structures roughly includes a hooking device, a winding device and a crank, by hooking and cocking the bowstring, together with winding the crank which connected to the winding device by the user, driving the winding device to retract and release the rope at both ends of the hooking device, synchronously drawing the bowstring to the triggering position.

The principle of the aforesaid winding device is to interact with multiple gears set internally to convert the driving force applied by the user to the crank by the gear ratio. In order to avoid rope loosening during the process, the winding device is equipped with a unidirectional mechanism (e.g., a one-way ratchet), but such a structure will generate mechanical noise during operation and interfere with the use of the crossbow, especially during a hunting activity.

SUMMARY OF THE INVENTION

In view of the above-mentioned problems and shortcomings of the prior a, an objective of the present invention is to provide a crossbow with a silent cocking device by way of structural innovation, to overcome the existing shortcomings of the prior art.

To achieve the above purpose, the silent cocking device includes a shaft extending through a positioning sleeve, reels, a housing, a bushing, covers, a shaft sleeve, limiting pieces and a clutch wrench. A crank is connected to an end of the shaft. The reels are connected to two ends of the shaft. The housing receives the bushing, which includes a hole and clutch slots. The covers are connected to both ends of the housing. Rollers are located in the clutch slots. The limiting pieces are arranged on two ends of the shaft sleeve. The clutch wrench includes a portion connected to the rollers in the housing and another portion extending from the housing.

DESCRIPTION OF THE PREFERRED EMBODIMENTS

Figure 1:
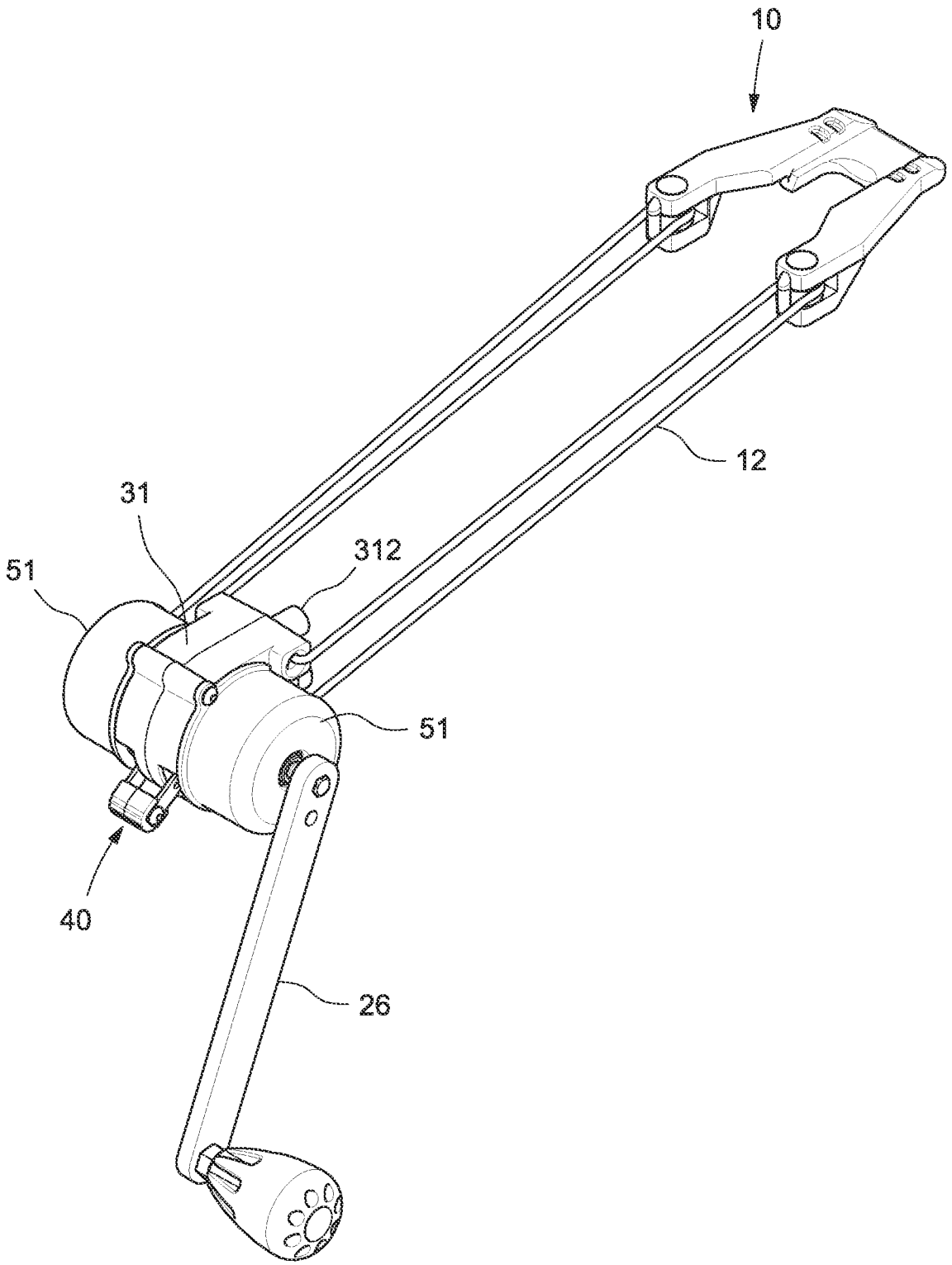
FIG. 1 is a perspective view schematically showing an embodiment of the present invention.
Figure 2:
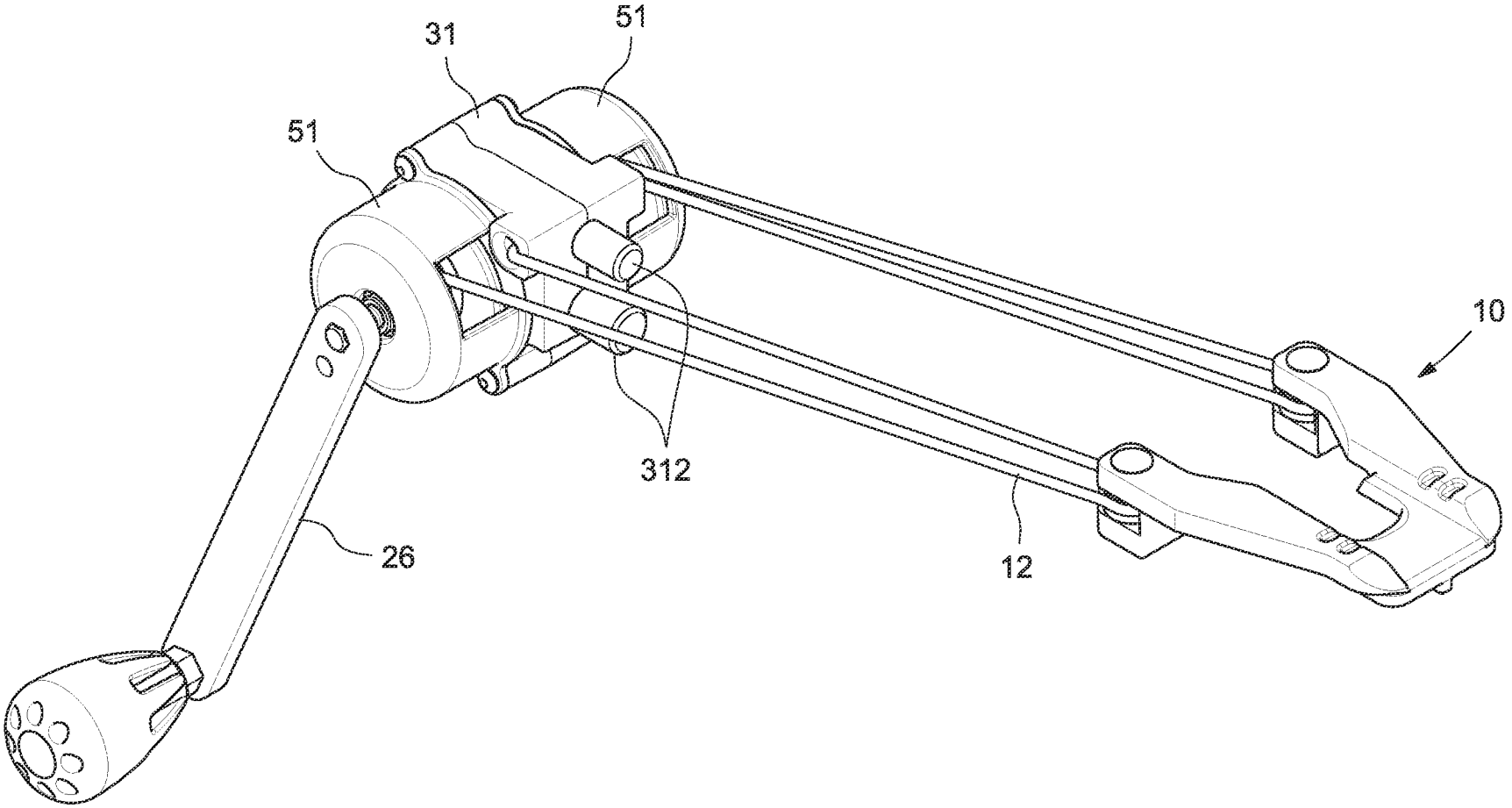
FIG. 2 is another view of the embodiment shown in FIG. 1.
Figure 3:
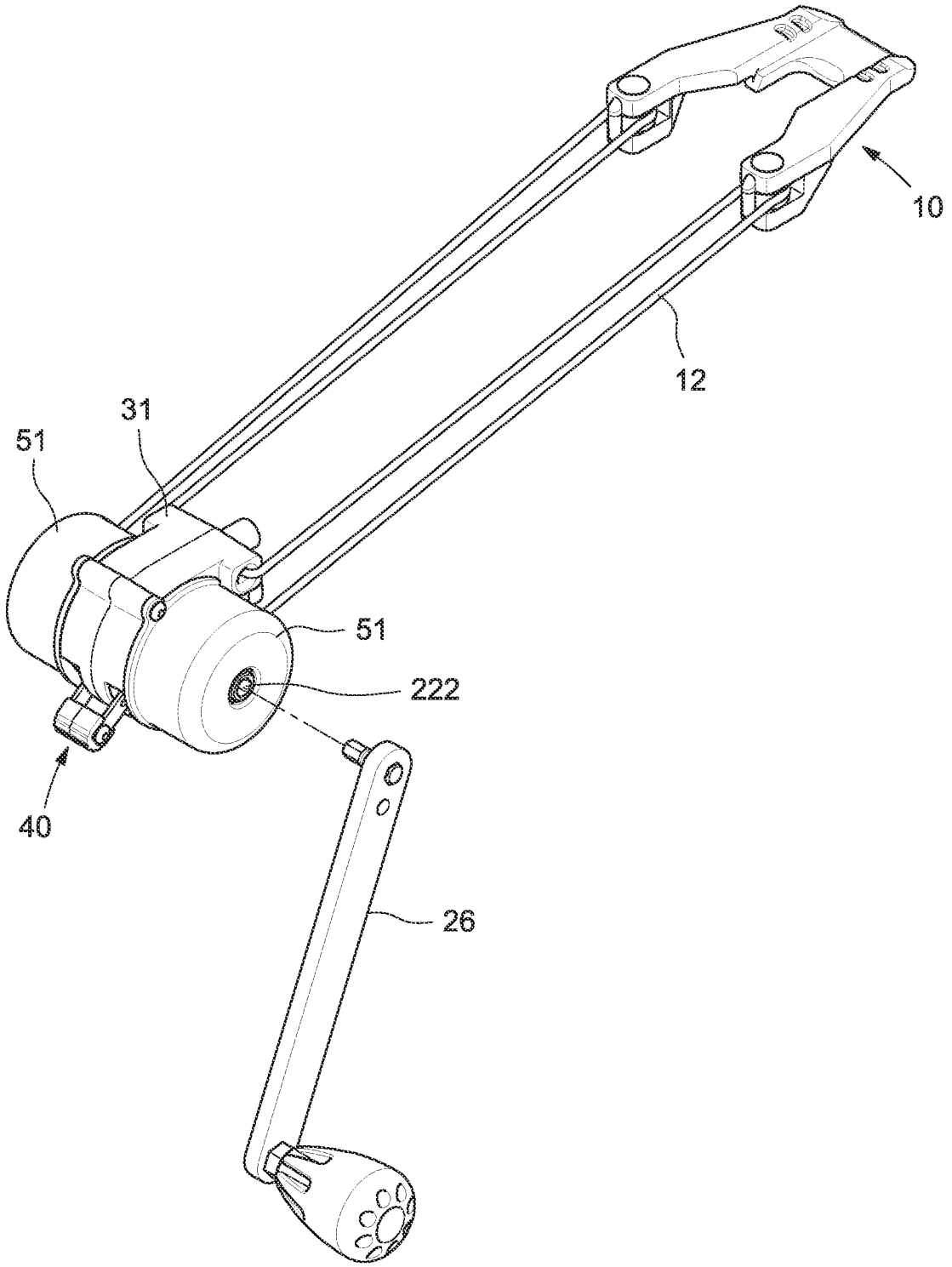
FIG. 3 is an exploded schematic view of the embodiment shown in FIG. 1.
Figure 4:
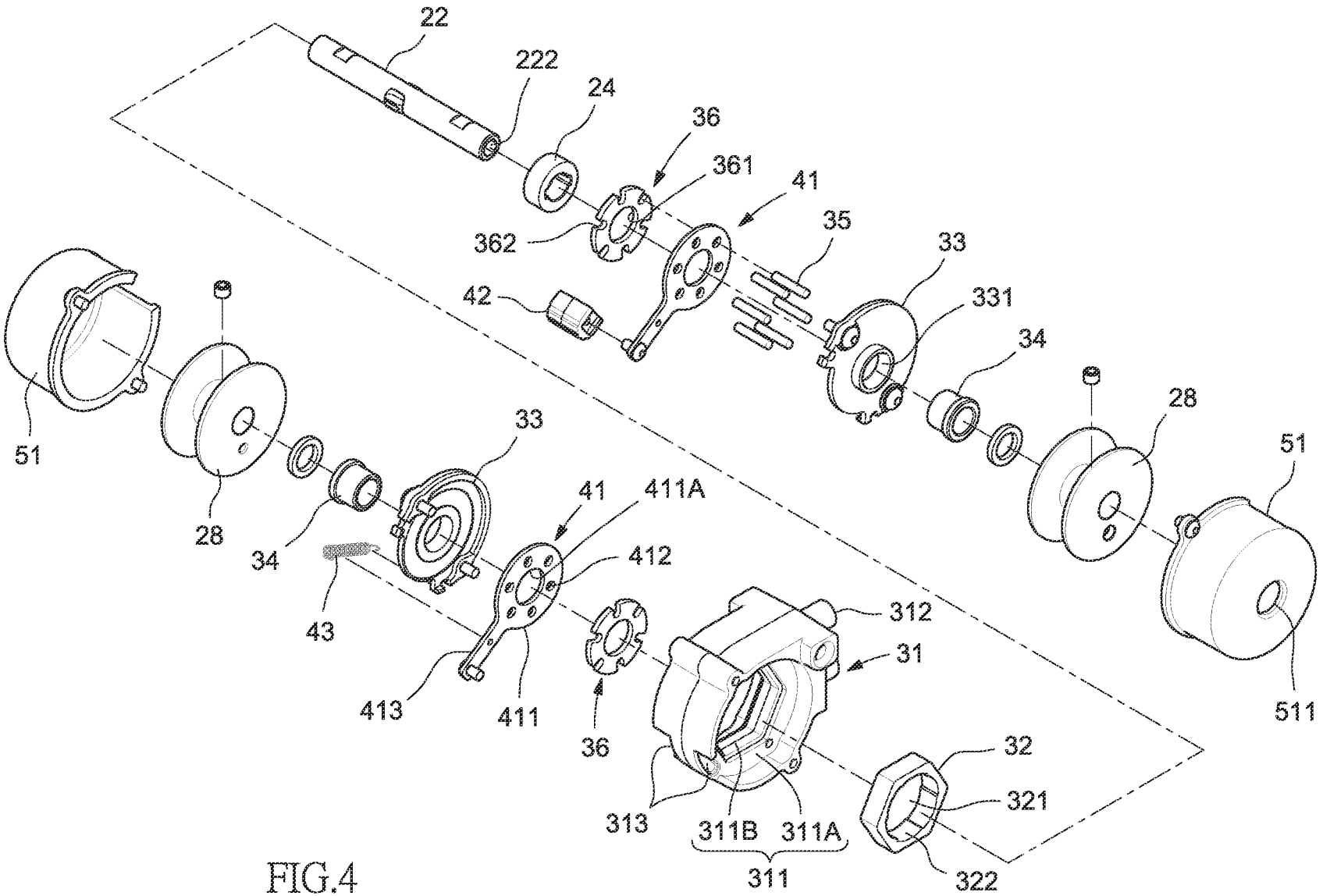
FIG. 4 is an exploded schematic view of the partial components of the embodiment shown in FIG. 3.
Figure 5:
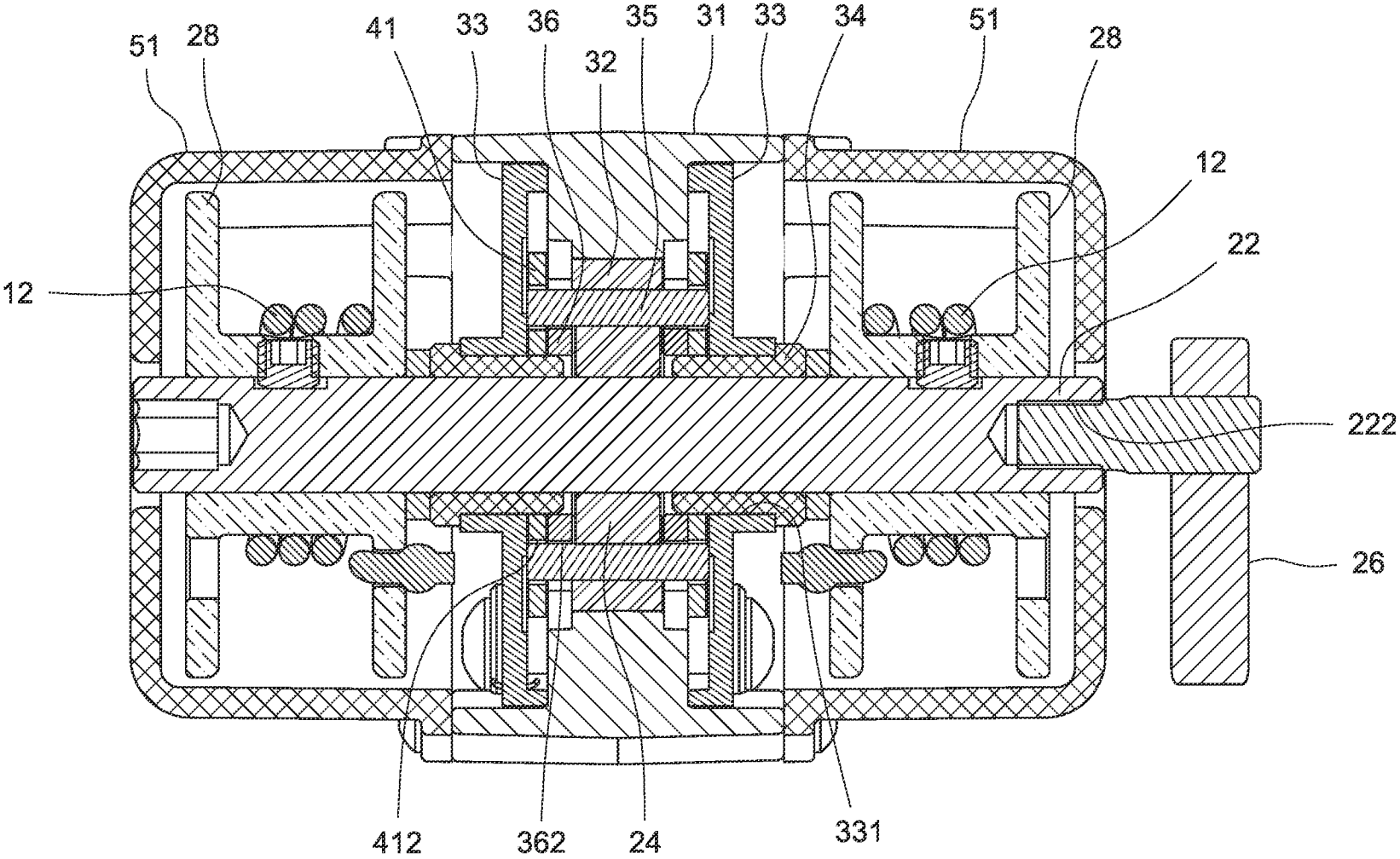
FIG. 5 is a schematic cross-sectional view of the embodiment shown in FIG. 1.

The following is a further description of the embodiment of the silent cocking device of the present invention with reference to the relevant drawings. The various objects in the embodiments are depicted in the proportions, dimensions, deformations, or displacements applicable to the description, rather than in the proportions of the actual components, as indicated. The same and symmetrical configuration of the components in the remaining embodiments are represented by the same number. In addition, the directional terms such as "front, back, left, right, top, bottom, inside, and outside" in the description of each embodiment listed below are in accordance with the specified direction of the view, and cannot be used as an explanation of the restrictions of the invention.

Referring to FIGS. 1 to 7, the silent cocking device of the present invention is for retracting and releasing a rope 12 connected to both ends of a hooking device 10, and includes a shaft 22, plural reels 28, a housing 31, a bushing 32, plural covers 33, plural rollers 35, plural limiting pieces 36, a clutch wrench 40, and two shells 51.

The said shaft 22 has a pre-defined profile and extends through a positioning sleeve 24. A screw (not numbered) includes an end located in a joint hole 222 made in an end of the shaft 22 and another end inserted in a hole (not numbered) made in a crank 26 so that the shaft 22 is connected to the crank 26. In another embodiment, the positioning sleeve 24 and the shaft 22 can be formed in one piece. Preferably, the joint hole 222 is a polygonal hole.

The above-mentioned reels 28 are connected to two ends of the shaft 22 to provide winding of the rope 12 on both ends of the hooking device 10.

The above housing 31 includes an installation hole 311, plural assembly posts 312, and plural connecting slots 313.

The said installation hole 311 extends through the housing 31 with and includes two large-diameter portions 311A configured at both ends of the installation hole 311 and a small-diameter portion 311B located between the large-diameter portions 311A; wherein the small-diameter portion 311B has a polygonal aperture cross-section.

Figure 6:
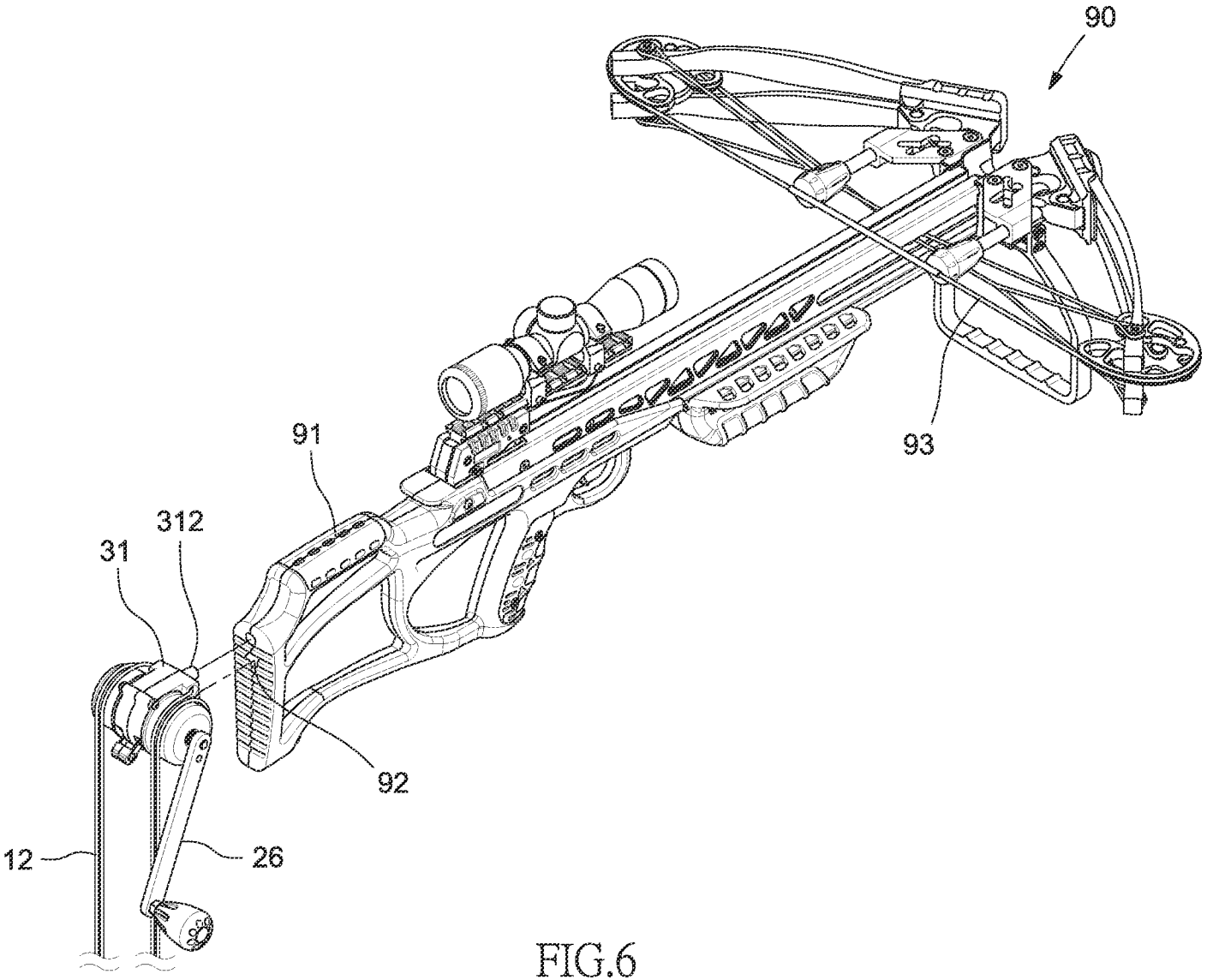
FIG. 6 is a schematic view of an embodiment of the present invention assembled in the crossbow.

The said assembly posts 312 are formed on the periphery of one end of the housing 31 for insertion into assembly holes 92 made in a rear end of a bow body 91 of a crossbow 90 (shown in FIG. 6). A cross-sectional profile of each assembly post 312 can be selected from different geometric designs or diameters, and each of the assembly posts 312 extends in a radial direction of the installation hole 311.

Each of the connection slots 313 is a cutout in a corresponding one of two ends of the housing 31.

The bushing 32 is fid in the small-diameter portion 311B of the installation hole 311 of the housing 31, and formed with a hole 321 and plural clutch slots 322. Preferably, an external profile of the bushing 32 is polygonal corresponding to the small-diameter portion 311B of the installation hole 311.

The said movable hole 321 extends through the bushing 32 to receive the positioning sleeve 24, which in turn receives a section of the shaft 22.

Figure 7:
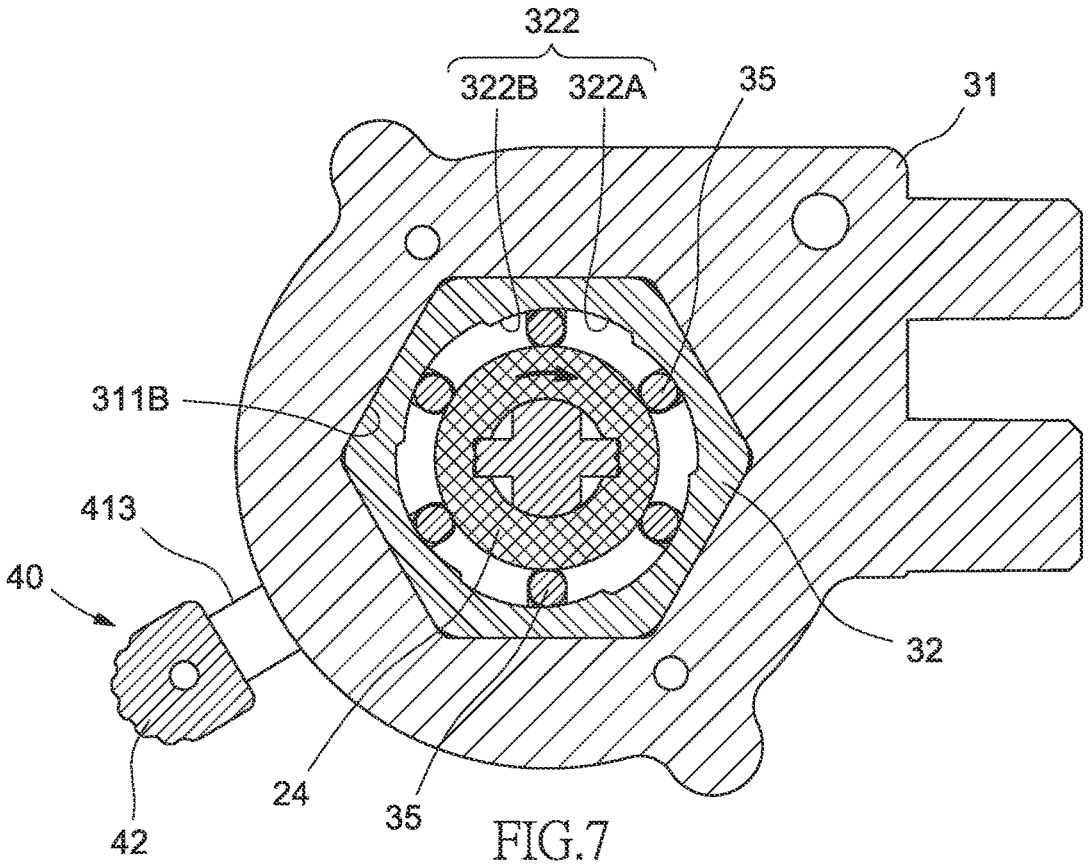
FIG. 7 is a schematic cross-sectional view showing an action of the embodiment of the present invention (1)

Each of the clutch slots 322 is recessed along a wall of the hole 321. Each clutch slot 322 (as shown in FIG. 7) has a free area 322A in a same rotation direction and a restraining area 322B in an opposite rotation direction, and the depth of the free area 322A is greater than that of the restraining area 322B.

The above-mentioned covers 33 are connected to the large-diameter portions 311A of the installation hole 311 of the housing 31 respectively, and each cover 33 is provided with a pivot hole 331 extending through the cover 33 for receiving a section of the shaft 22. Preferably two shaft sleeves 34 are used. Each shaft sleeve 34 is provided between a wall of the pivot hole 331 of a corresponding one of the covers 33 and a corresponding section of the shaft 22.

Each roller 35 is provided in each clutch slot 322 and is partially abutted against the positioning sleeve 24 of the shaft 22.

The limiting pieces 36 are substantially in the shape of a ring and respectively located against the two ends of the positioning sleeve 24. Each of the limiting nieces 36 is formed with a perforation 361 and plural limiting recesses 362.

The perforation 361 is extends through a central portion of each of the limiting pieces 36 to receive a corresponding one of the shaft sleeves 34 which receives a corresponding section of the shaft 22.

The limiting recesses 362 are evenly made in a periphery of each of the limiting piece 36. Each of the limiting recesses 362 receives an end of a corresponding one of the rollers 35.

The clutch wrench 40 includes two clutch plates 41, a connector 42, and an elastic element 43.

Each of the said clutching plates 41 has an annular part 411, plural oval holes 412, and an extension part 413.

The said annular part 411 extends around a perforation 411A. The perforation 411A extends through the clutch plate 41 to receive the corresponding shaft sleeve 34 which receives a corresponding section of the shaft 22.

The oval holes 412 extend through the clutch plate 41, and are evenly arranged in a circle in the annular part 411 to receive the rollers 35 corresponding to the limiting recesses 362 in the limiting piece 36. The oval holes 412 are larger than the limiting recess 362.

The aforementioned extension part 413 extends outward from the annular part 411, and one end of the extension part 413 extends out of the housing 31 through a corresponding one of the connecting slots 313.

The said connector 42 includes two ends each of which is connected to the end of the extension part 413 of each clutch plate 41 located out of the housing 31, so that the clutch plates 41 can be synchronized to pivot around the shaft sleeves 34 which receive two sections of the shaft 22.

The said elastic element 43 includes an end connected to a selected one of the covers 33 and another end connected to a corresponding one of the clutch plates 41.

The shells 51 are connected to both ends of the housing 31. Each of the shells 51 receives a corresponding one of the reels 28 and includes an aperture 511 extending through the shell 51 to receive one end of the shaft 22.

Overall, the above is a description of the various components and assembly methods of the silent cocking device for a better embodiment of the present invention, and the operating features of the embodiment are introduced as follows.

As shown in FIG. 6, when the user has the need to cock a string of the crossbow 90, the assembly posts 312 on the housing 31 are inserted in the assembly holes 92 in the rear end of the bow body 91 to complete the assembly. When not in use, the silent cocking device is removed from the crossbow 90 and stored to avoid interfering with shooting of an arrow (not shown) from the crossbow 90.

Figure 8:
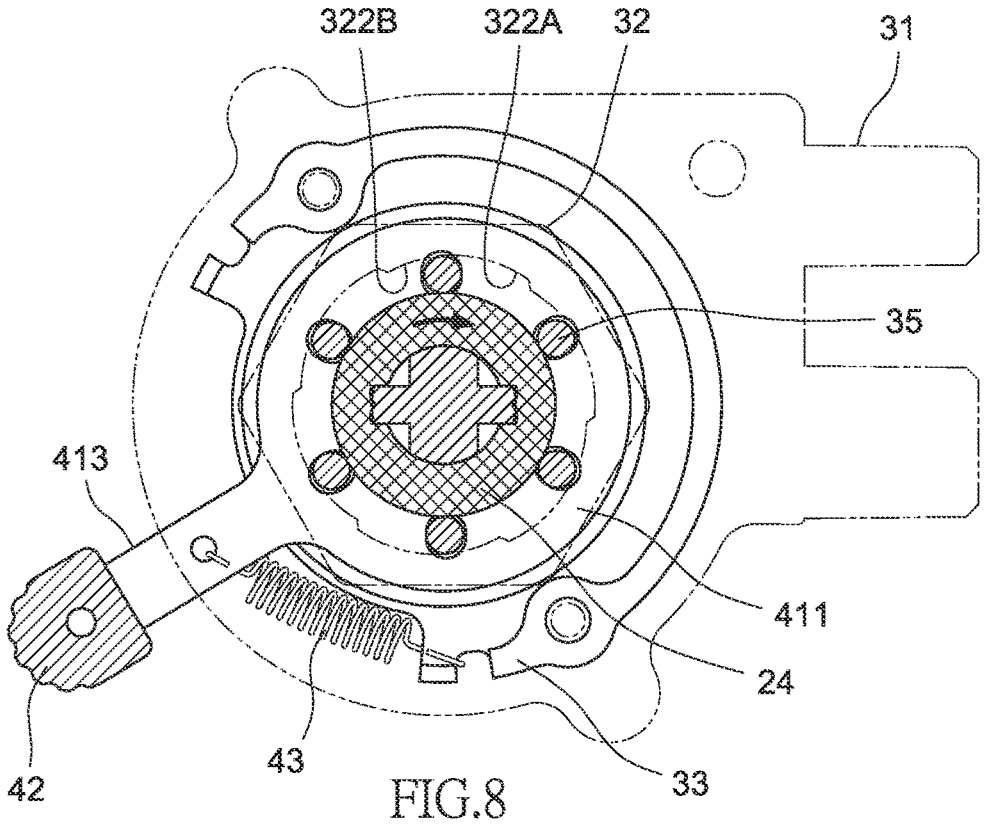
FIG. 8 is a schematic cross-sectional view showing an action of the embodiment of the present invention (2)

Under a normal circumstance as shown in FIGS. 7 and 8, the extension part 413 of the selected clutch plate 41 of the clutch wrench 40 is pulled by the elastic element 43, so that an edge of the oval hole 412 of each clutch plate 41 synchronously moves each roller 35 toward the restraining area 322B at one end of the corresponding clutch slot 322 and, as a result, each roller 35 is placed against the positioning sleeve 24 of the shaft 22, and the shaft 22 and the reels 28 cannot pivot in the predetermined direction.

Figure 9:
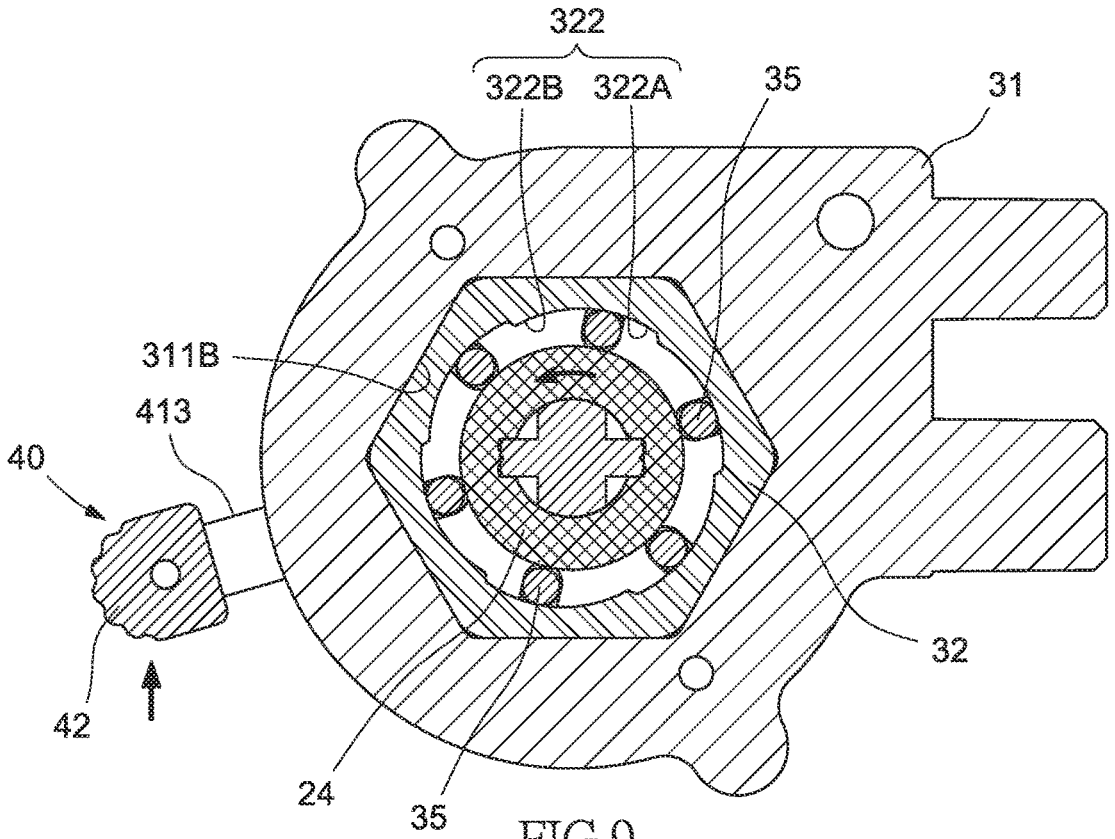
FIG. 9 is a schematic cross-sectional view showing an action of the embodiment of the present invention (3)
Figure 10:
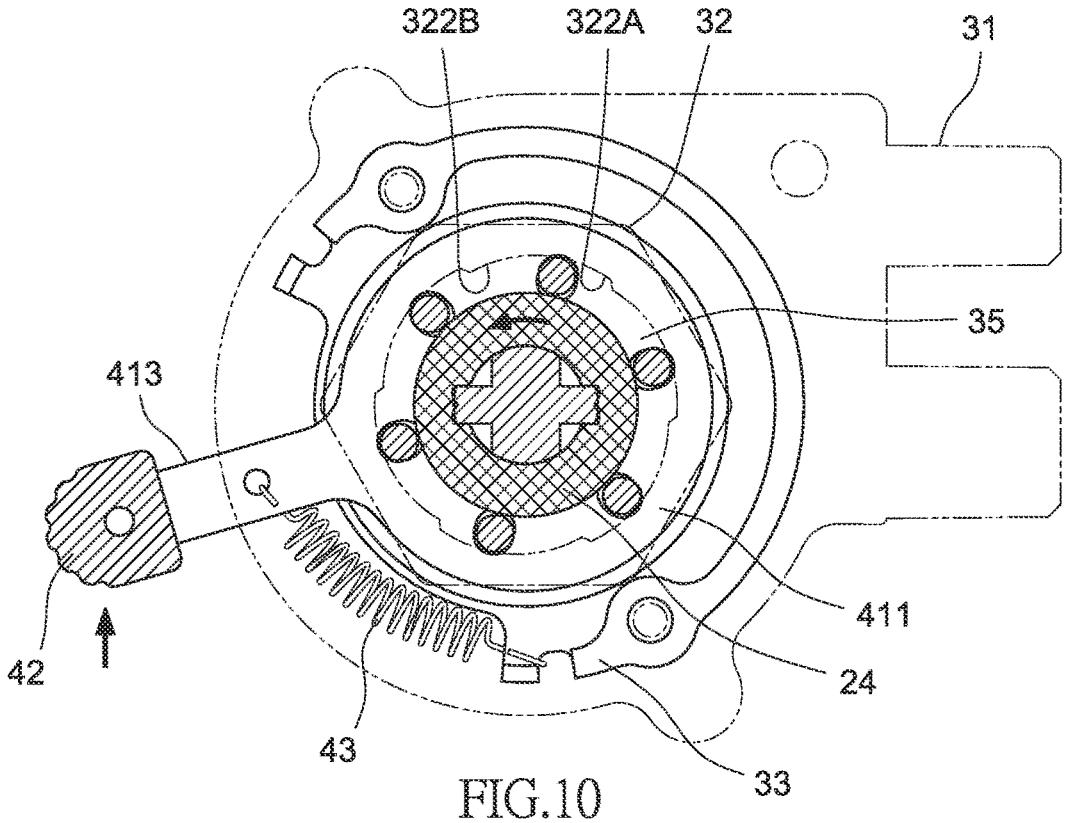
FIG. 10 is a schematic cross-sectional view showing an action of the embodiment of the present invention (4)
Figure 11:
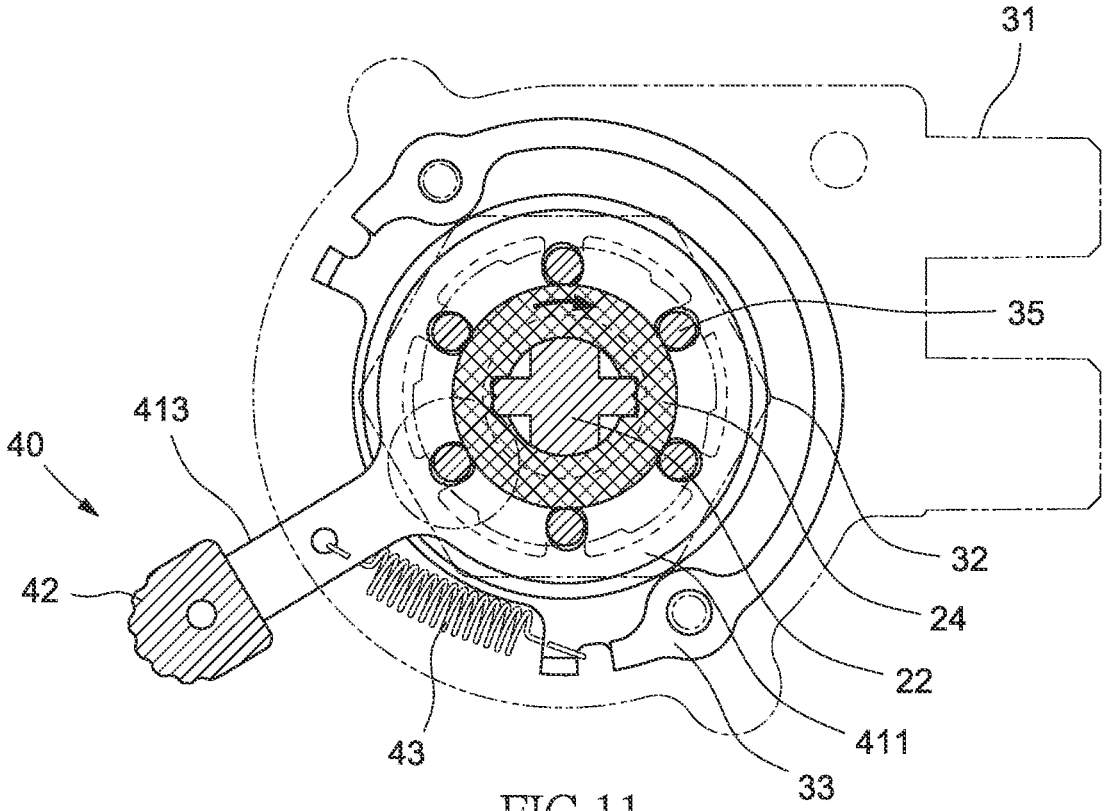
FIG. 11 is a schematic cross-sectional view showing an action of the embodiment of the present invention (5)
Figure 12:
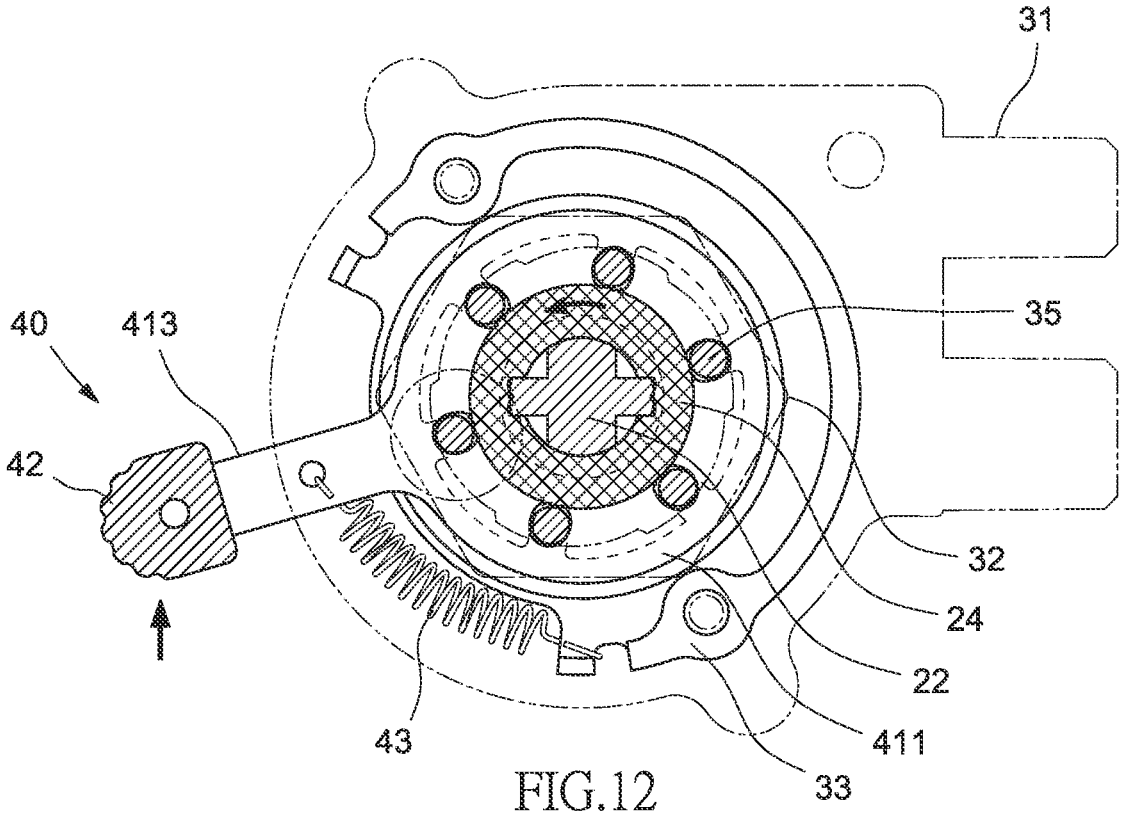
FIG. 12 is a schematic cross-sectional view showing an action of the embodiment of the present invention (6)
Figure 13:
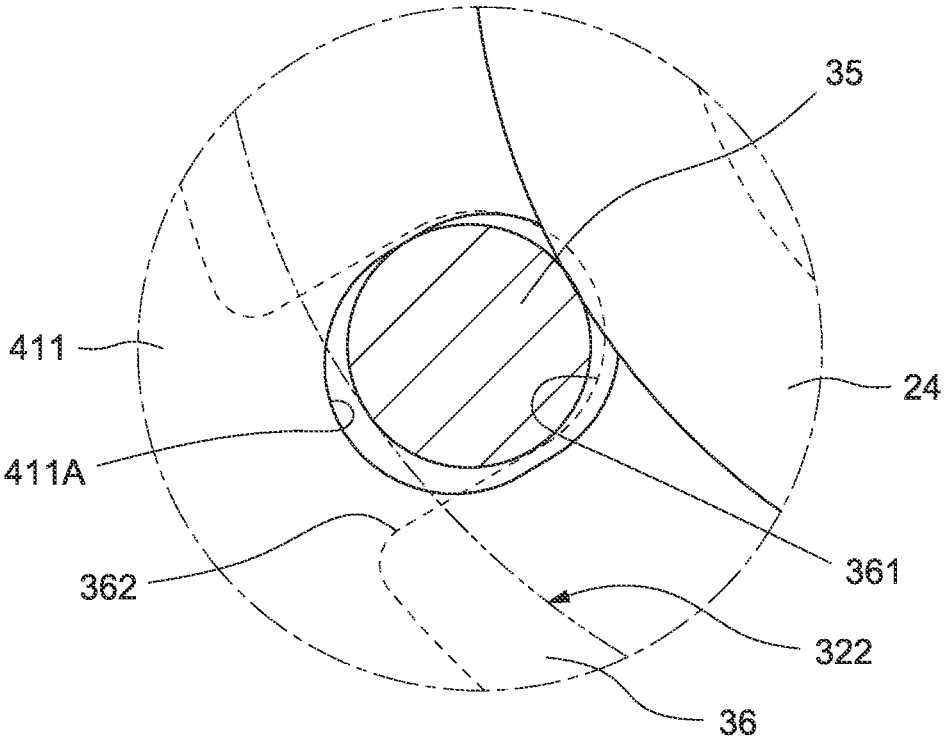
FIG. 13 is a partial schematic view of the embodiment shown in FIG. 11.
Figure 14:
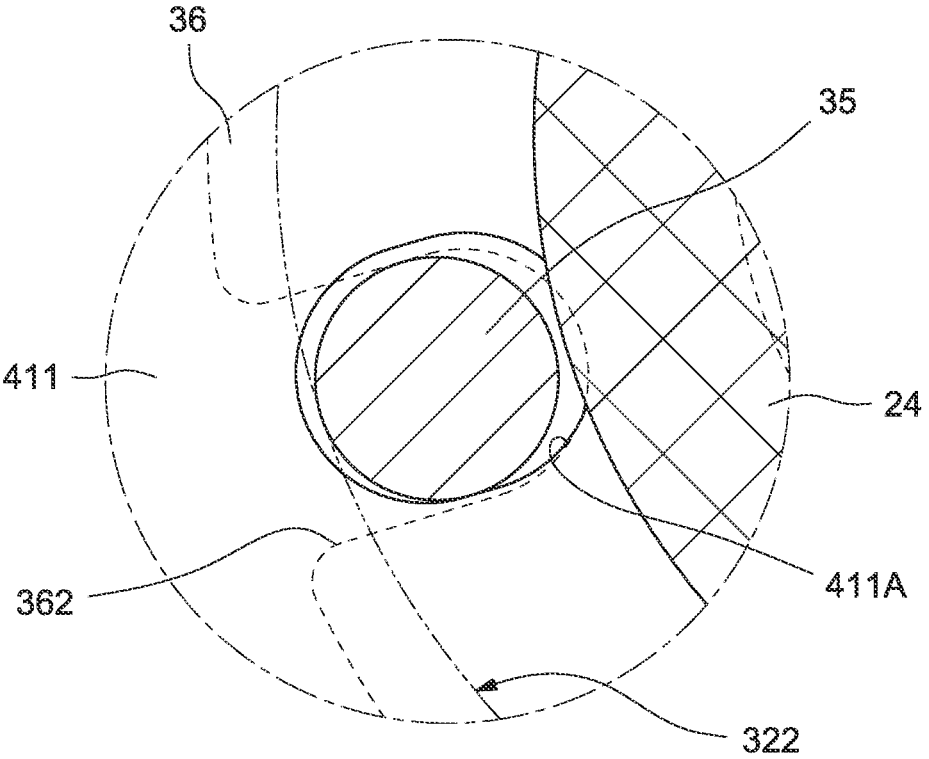
FIG. 14 is a partial schematic view of the embodiment shown in FIG. 12.

When the user wants to draw the bowstring 93 of the crossbow 90, as shown in FIGS. 9 and 10, the connector 42 of the clutch wrench 40 can be operated to synchronously pivot the clutch plates 41 around the shaft 22. During the process, the edge of each oval hole 412 of one clutch plate 41 and the edge of each oval hole 412 of the other clutch plate 41 synchronously move the two ends of each roller 35 from the restraining area 322B of the corresponding clutch slot 322 to the free area 322A.

When the rollers 35 are in the free areas 322A of the clutch slots 322, the shaft 22 is no longer restrained by the rollers 35 and can pivot freely. At this time, the user can pull the hooking device 10 to release the rope 12 from the reels 28 to a preset length until the hooking device 10 can hook the bowstring 93 of the crossbow 90, and then release the clutch wrench 40 (connector 42) to return the clutch wrench 40 to the normal state (as described above).

At this time, the user can wind the crank 26 attached to one end of the shaft 22 to synchronously rotate the shaft 22 and the reels 28, during which the shaft 22 (positioning sleeve 24) rotates toward the free areas 322A of the clutch slots 322 of the bushings 32 and simultaneously move the rollers 35 toward the free areas 322A of the clutch slots 322. Therefore, each roller 35 does not prevent the shaft 22 (positioning sleeve 24) from rotation, so that the reels 28 at both ends of the shaft 22 can wind the rope 12 of the hooking device 10 and simultaneously draw the bowstring 93 in the direction of the cocking until the bowstring 93 is pulled to the triggering position.

At this time, the user can then shake the connector 42 of the clutch wrench 40, to let the shaft 22 in a free pivoting state, so that the user can detach the hooking device 10 from the bowstring 93, then release the clutch wrench 40 and crank the crank 26 to drive the shaft 22 to wind up the excess rope 12 of the hooking device 10, until the hooking device 10 is wound up to the preset position.

In the process of the above bowstring 93 being drawn, a reaction force will be applied to the hooking device 10 (rope 12). Therefore, when the crank 26 no longer applies force to the shaft 22 (positioning sleeve 24) during the above process, the shaft 22 (positioning sleeve 24) will pivot in the opposite direction due to the reaction force, so as to move each roller 35 toward the restraining area 322B of the clutch slot 322, thereby achieving the limitation of unidirectional operation and overcoming the shortcomings of the prior arts, such as the noise from one-way gear operation.

In addition, as shown in FIGS. 11 to 14, in the process of shaking the clutch wrench 40, the structure of each oval hole 412 on each clutch plate 41 is designed to be larger than the limiting recess 362 of the restriction plate 36. Therefore, when the clutch plate 41 pivots on the axis of the shaft 22, through this gap difference, the wall of each oval hole 412 will impact each roller 35 to move each roller 35 to reduce the maximum static friction of each roller 35, allowing users to operate more effortlessly and smoothly.

While the present invention has been described by means of specific embodiments, numerous modifications and variations could be made thereto by those skilled in the art without departing from the scope and spirit of the present invention set forth in the claims.

What is claimed is:

1. A silent cocking device operable to retract and release a rope connected to two ends of a hooking device, the silent cocking device comprising:

a shaft formed with two ends;

a positioning sleeve extending around the shaft so that they are not rotatable relative to each other;

a crank connected to one of the two ends of the shaft;

two reels respectively connected to the two ends of the shaft to provide winding of the rope;

a housing comprising two ends, an installation hole extending through the housing and two connecting slots respectively in the ends of the housing;

a bushing located in the installation hole and formed with:

a central hole extending through the bushing to receive the positioning sleeve; and plural clutch slots in a wall of the central hole, wherein each of the clutch slots comprises a free area at an end and a restraining area at an opposite end;

plural rollers each of which comprises two ends and a middle section in contact with the positioning sleeve in a corresponding one of the clutch slots;

two limiting pieces respectively in contact with two sides of the positioning sleeve, wherein each of the two limiting pieces comprises a perforation for receiving the shaft and plural limiting recesses each of which receives a corresponding one of the ends of a corresponding one of the rollers;

a clutch wrench including:

two clutch plates each of which comprises an annular part extending around the shaft and an extension part extended from the annular part and formed with an end extending out of the housing through a corresponding one of the connecting slots, wherein the annular part comprises oval holes each of which receives a corresponding one of the two ends of a corresponding one of the rollers;

a connector for interconnecting the ends of the extension parts of the clutch plates; and an elastic element comprising an end connected to one of the covers and another end connected to the extension part of one of the clutch plates; and two covers respectively connected to the ends of the housing to keep the rollers, the limiting pieces and the annular parts of the clutch plates in the installation hole, wherein each of the covers comprises a pivot hole through which a corresponding one of the ends of the shaft extends from the installation hole.

2. The silent cocking device according to claim 1, comprising two shaft sleeves each of which is provided between a wall of the pivot hole of a corresponding one of the covers and the shaft.

3. The silent cocking device according to claim 1, comprising two shells respectively connected to the ends of the housing, wherein each of the shells comprises an aperture for receiving a corresponding one of the ends of the shaft.

4. The silent cocking device according to claim 1, wherein the shaft is provided with a joint hole in at least one end.

5. The silent cocking device according to claim 1, wherein each of the oval holes is larger than each of the limiting recesses.

6. The silent cocking device according to claim 1, wherein the housing has plural assembly posts insertable in plural assembly holes made in a crossbow.

7. The silent cocking device according to claim 6, wherein each of the assembly posts is selected from different geometric profiles or diameters.

8. The silent cocking device according to claim 1, wherein the installation hole comprises two large-diameter portions respectively made in the ends of the housing and a small-diameter portion between the large-diameter portions.

9. The silent cocking device according to claim 8, wherein the bushing is located in the small-diameter portion, and each of the covers closes a corresponding one of the large-diameter portions.

10. The silent cocking device according to claim 8, wherein the small-diameter portion is polygonal, and the bushing is polygonal.

* * * * *